US006036292A

United States Patent [19]

Mandel et al.

[11] Patent Number: 6,036,292

[45] Date of Patent: Mar. 14, 2000

[54] REFRIGERATOR CABINET INCORPORATING A PLASTIC KICKFACE

[75] Inventors: Sheldon W. Mandel, East Galesburg; John P. Myers; Gerald L. Wolanin, both of Galesburg, all of Ill.

[73] Assignee: Maytag Corporation, Newton, Iowa

[21] Appl. No.: 09/102,817

[22] Filed: Jun. 23, 1998

[51] Int. Cl.[7] ..... A47B 96/04

[52] U.S. Cl. ..... 312/405; 312/401; 312/236

[58] Field of Search ..... 62/440, 441, 455, 62/454, 265; 312/236, 401, 405, 406, 278

[56] References Cited

U.S. PATENT DOCUMENTS

| | | | |
|---|---|---|---|
| 2,660,505 | 11/1953 | Eck | 312/236 |
| 2,889,901 | 3/1958 | Morrissey, Jr. et al. . | |
| 3,157,306 | 11/1964 | Courson | 312/405 |
| 3,236,576 | 12/1964 | Dawley . | |
| 3,269,789 | 8/1966 | Crowe | 312/405 X |
| 3,305,287 | 2/1967 | Rait | 312/236 X |
| 3,442,563 | 5/1969 | Scroop | 312/405 |
| 4,932,224 | 6/1990 | Katterhenry et al. | 312/236 |
| 4,932,729 | 6/1990 | Thompson et al. | 312/405 |
| 5,215,367 | 6/1993 | Montuoro et al. | 312/401 |
| 5,265,954 | 11/1993 | Keil | 312/405 |
| 5,385,032 | 1/1995 | Martin et al. | 62/441 X |
| 5,522,656 | 6/1996 | Jenkins | 312/405 X |
| 5,787,724 | 8/1998 | Pohl et al. | 312/405 X |

FOREIGN PATENT DOCUMENTS

| | | | |
|---|---|---|---|
| 837384 | 6/1960 | United Kingdom | 2312 406 |

*Primary Examiner*—Peter M. Cuomo
*Assistant Examiner*—James O. Hansen
*Attorney, Agent, or Firm*—Everett G. Diederiks, Jr.

[57] ABSTRACT

A plastic kickface, that consolidates a conventional metal face plate and a plastic kickplate, extends across a lowermost frontal portion of a shell of a refrigerator cabinet assembly. At least one lower door hinge bracket is secured to reinforcement structure of the cabinet shell by fasteners that extend through tubular spacers located in holes formed in the plastic kickface. Provisions are made for creating a seal along a lower section of a door of the refrigerator cabinet assembly by interconnecting the kickface with a sealing strip that is adapted to be engaged by a section of an annular gasket attached to the door of the refrigerator cabinet assembly. When the door incorporates a magnetic sealing gasket, a metal strip is provided, with the strip being integrated into a face portion of the kickface in accordance with certain embodiments of the invention while, in accordance with another embodiment, the strip is first attached to the cabinet shell and then the kickface is interconnected to both the strip and the reinforcement structure.

20 Claims, 7 Drawing Sheets

57
109
90
88
86
80
105
104
70
74
75
73
81
82
83
89
38
84
112
117
114
120
125
121
124
17
20
21
67
99
71

57
128
120
121
114
67
17
74
75
73
80
81
71
124
-112-
90

5
130
132
104
105
9
112
57
V
84
88
89
90
86
38
83
V 57
121
112
71
114
38
67
139
136
84
74
75

REFRIGERATOR CABINET INCORPORATING A PLASTIC KICKFACE

BACKGROUND OF THE INVENTION

1. Field of the Invention

The present invention pertains to the art of refrigerator cabinets and, more particularly, to the incorporation of a plastic kickface that extends across a lower frontal section of a refrigerator cabinet, through which a lower door hinge is secured to the refrigerator cabinet and which is joined with a member adapted to be engaged by a seal for at least one door of the refrigerator.

2. Discussion of the Prior Art

In constructing a refrigerator cabinet, it is common practice to structurally interconnect lower end portions of cabinet shell side panels with a laterally extending metal face plate. In addition to enhancing the structural integrity of the cabinet shell, the metal face plate defines a surface that is adapted to be engaged by a lower section of a seal extending about an inner peripheral portion of a door that is mounted to the cabinet shell for pivotal movement between open and closed positions. The metal face plate also serves as a mounting support for a lower hinge bracket upon which the door is pivotally mounted. In addition to the use of a metal face plate, it is common practice to provide a plastic kickplate, which also extends across a lower frontal portion of the cabinet shell. Such a plastic kickplate can be either directly attached to the metal face plate or to primary flange structure created by roll-forming or otherwise bending frontal edge sections of the side panels. In either case, the plastic kickplate is positioned below the lowermost edge of the door and often covers at least a portion of the lower hinge bracket.

Such a conventional refrigerator cabinet construction suffers from various disadvantages. First of all, forming a refrigerator cabinet with both a metal face plate and a separate plastic kickplate increases the overall manufacturing costs. Not only do separate, rather thick plate elements need to be formed, but the plates must be individually attached at distinct times during the overall assembly of the refrigerator cabinet. In addition, further manufacturing costs are incurred since the metal face plate must be painted in order to prevent rusting thereof.

Based on the above, there exists a need in the art of refrigerators for an improved cabinet assembly that minimizes the associated manufacturing costs and simplifies the overall assembly of the cabinet, while maintaining the structural and aesthetically pleasing characteristics of known prior art refrigerator cabinet arrangements.

SUMMARY OF THE INVENTION

The present invention is directed to a refrigerator cabinet that consolidates two separate components, i.e., a metal face plate and a plastic kickplate, of a conventional refrigerator assembly into a plastic kickface in order to reduce costs and increase the overall manufacturing efficiency associated with the refrigerator cabinet. More specifically, the cabinet assembly of the invention includes a shell that is formed by opposed, upright side panels which are spaced and interconnected by a top panel. Both the top and side panels have forwardmost portions which are bent to define primary and return flange portions of the cabinet. In a manner known in the art, the primary and return flanges define an elongated cavity which is adapted to receive one or more liners therein.

In accordance with the invention, the plastic kickface extends across a frontal section of the cabinet shell at the lower end portions of the side panels. At least one lower door hinge bracket is secured to reinforcement structure of the cabinet shell by means of fasteners that extend through receiving bosses formed in the plastic kickface. Actually, in order to prevent cold flowing of the plastic material of the kickface when torque is applied to the hinge bracket mounting fasteners and to avoid directly transferring compression loads to the plastic kickface upon assembly of the hinge bracket, tubular metal spacers are pressed into the receiving bosses, preferably immediately after the molding cycle for the kickface is completed such that the kickface is still warm and therefore provides good retention of the spacers after the plastic cools. Advantageously, this hinge bracket mounting arrangement indirectly attaches the kickface to the cabinet shell, while still providing a secure attachment for the lower hinge bracket. When applied to a side-by-side style refrigerator, the kickface is further connected to the cabinet shell through a pair of laterally spaced, lower hinge brackets, as well as through the use of a central fastening arrangement that interconnects a mullion bar to reinforcing structure of the cabinet shell.

Since there is no separate metal face plate utilized in the cabinet assembly of the present invention, provisions must be made for creating a seal along a lower section of a door pivotally mounted to the shell of the cabinet. In accordance with one form of the invention, the lower section of the door overlies a portion of the plastic kickface when the door assumes a closed position. In the manner known in the art, the door is provided with a seal that extends annularly about an interior peripheral portion thereof. Since primary seals of refrigerator doors typically utilize magnetic sealing arrangements, the plastic kickface of the present invention has secured thereto a metal strip provided to cooperate with the door seal.

In accordance with a first embodiment of the invention, an elongated recess is formed in the kickface and the metal strip is secured within the recess. In a second embodiment, the kickface is actually molded about the metal strip such that at least a portion of the metal strip is encapsulated. In a third embodiment of the invention, a separate sealing strip is first mounted to the cabinet and then the plastic kickface is interconnected with this strip, while also accommodating the mounting of one or more lower hinge brackets therethrough. In accordance with this embodiment, a portion of the kickface overlies the metal strip to enhance the overall aesthetic appearance of the cabinet assembly, while the lower section of the door seal can directly engage the sealing strip.

With this arrangement, the size and associate cost of the components utilized to form the overall cabinet assembly is reduced and the assembly efficiency of the overall cabinet can be increased. In any event, additional features and advantages of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
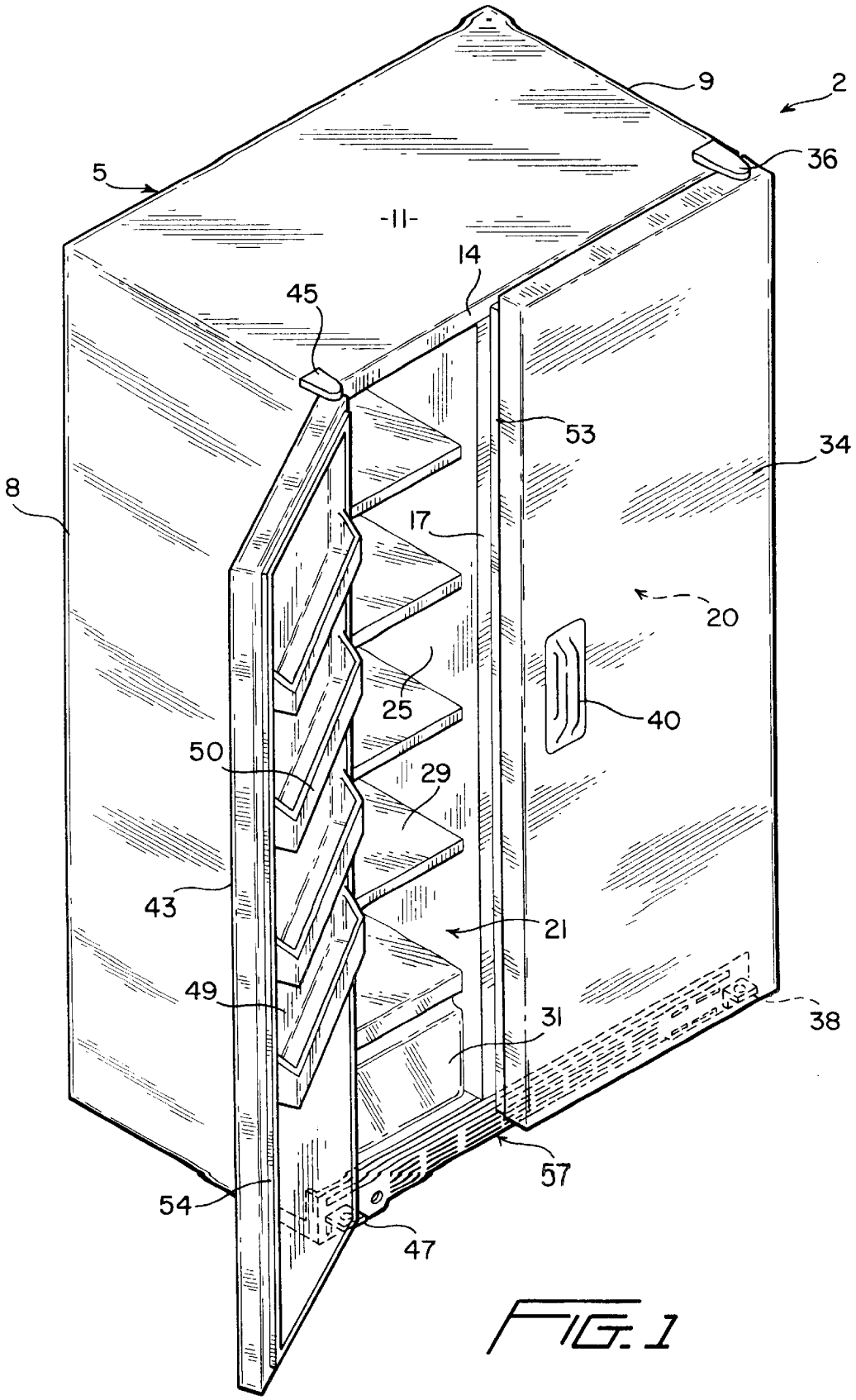
FIG. 1 is a perspective view of a refrigerator cabinet assembly constructed in accordance with the present invention.

With initial reference to FIG. 1, the present invention will now be described with reference to a side-by-side refrigerator cabinet generally indicated at 2. Refrigerator cabinet 2 includes a cabinet shell 5 that includes a pair of laterally spaced side panels 8 and 9, each of which includes upper and lower end portions (not separately labeled) and a top panel 11 that interconnects the upper end portions of side panels 8 and 9. In a manner known in the art, side panels 8 and 9 and top panel 11 are preferably formed from a single piece of sheet metal that is roll-formed to define cabinet shell 5. The sheet metal is also formed with face portions, one of which is associated with top panel 11 and indicated at 14.

Although not particularly shown in FIG. 1, but which will be discussed more fully below with reference to FIG. 4, the face portion 14, as well as the corresponding face portions associated with side panels 8 and 9, is defined by roll-forming the corresponding panel sheet to define a primary flange having a forward facing surface, a secondary flange which is bent back against the primary flange and a return flange that extends generally parallel to the primary flange but which is spaced rearward from the primary flange. In this manner, a cavity is defined between the primary and return flanges. Within the cavity associated with face portion 14, is positioned an upper end of a mullion bar 17. As is also known in the art, mullion bar 17 extends generally vertically within cabinet shell 5 and generally divides cabinet shell 5 into a fresh food compartment 20 and a freezer compartment 21. In a manner similar to face portion 14, mullion bar 17 includes cavity defining structure which cooperates with the cavity structure of the top panel 11 and a respective side panel 8, 9 in order to mount respective compartment defining liners within cabinet shell 5. For example, the cavities associated with side panel 8, top panel 1I1 and mullion bar 17 are adapted to receive flange portions of a freezer liner 25 that actually defines freezer compartment 21 within cabinet shell 25. Another liner arrangement (not shown) is used to define fresh food compartment 20. As illustrated in this Figure, freezer liner 25 has attached thereto a plurality of vertically spaced shelves 29 and can also be provided with a slidably mounted bin 31.

Again, the above-described construction of refrigerator cabinet 2 is known in the art and not illustrated in detail in the figures since it is not considered part of the present invention. For this reason, this preferred construction should not be considered limiting to the present invention and other construction arrangements for refrigerator cabinet 2 can be readily incorporated. For instance, the face portions associated with side panels 8 and 9, top panel 11 and mullion bar 17 need not include fore-to-aft spaced primary and return flanges, but rather flanges defining cavities which open forwardly of cabinet shell 5 to receive respective liners in a front loading manner could be employed as is also known in the art. In any event, it should simply be realized that refrigerator cabinet 2 can take various forms known in the art without departing from the present invention as will be realized more fully below in describing unique aspects of the overall invention.

However, for the sake of completeness, FIG. 1 also illustrates the presence of a fresh food door 34 that is pivotally mounted for movement between open and closed positions through the use of upper and lower hinge units 36 and 38, which generally take the form of brackets. Fresh food door 34 is provided with a handle 40 for manually manipulating the same. In a similar manner, the freezer door 43 is pivotally mounted through upper and lower hinge units 45 and 47 and is provided with a similar handle arrangement (not shown). Freezer door 43 is shown to include a door liner 49 that is provided with various shelves 50. In addition, each of the fresh food and freezer doors 34 and 43 is provided with a respective annular gasket 53 and 54 that is adapted to be sealed against respective face portions of cabinet shell 5 when doors 34 and 43 are closed. In addition, each annular gasket 53 and 54 is adapted to be sealed against a portion of a kickface 57 provided at a lowermost frontal portion of cabinet shell 5. Actually, it is the construction of kickface 57 and the incorporation of kickface 57 into the overall refrigerator cabinet 2 that constitutes the present invention. Therefore, reference will now be made to FIG. 2 in describing the construction of kickface 57 in accordance with a first preferred embodiment of the invention.

Kickface 57 includes a front face 67 that terminates in rearwardly projecting right and left side extensions 70 and 71. Actually, each end of kickface 57 is provided with a pair of laterally spaced, upstanding legs 73 and 74 that are interconnected by a base 75. The distance between legs 73 and 74 is made slightly greater then a base distance associated with each of the side panels 8 and 9 for the reason which will become clear hereinafter. In general, the right and left lateral end sections of kickface 57 are symmetrically constructed with basically only one variation. Therefore, the preferred construction of the right end of kickface 57 as viewed in FIG. 2 will now be described in detail and is to be understood that the left end of kickface 57 is similarly constructed, with the single variation being particularly pointed out below.

Directly adjacent right side extension 70 along front face 67 is formed a plurality of outwardly projecting bosses 80–83. In the preferred embodiment, bosses 80–83 are arranged in a generally square configuration, with bosses 80–82 being formed with central through holes (not separately labeled), each of which is adapted to receive a respective threaded fastener 84 for securing lower hinge bracket 38 to cabinet shell 5. Since kickface 57 is molded of plastic, specific provisions are taken to assure that kickface 57 is not deformed when torque is applied to fasteners 84 and also does not bear the weight of fresh food door 34. However, these particular provisions will be described more fully below with reference to FIGS. 4 and 5. Since only three fasteners 84 are utilized in the preferred embodiment to mount lower hinge bracket 38, boss 83 is not provided with a corresponding through hole in accordance with the present invention and is merely provided to assure that the lower hinge bracket 38 does not wobble upon completion of the assembly process. Of course, it should be realized that a fourth fastener 84 could also be readily utilized without departing from the spirit of the invention.

Located laterally inwardly of bosses 80–83 is a hole 86 that extends through front face 67. In the preferred embodiment, refrigerator cabinet 2 is provided with a vertically adjustable wheel assembly (not shown) for use in maneuvering and leveling of cabinet shell 5. Actually, the use of such adjustable wheel assemblies are quite old in the art. In any event, the hole 86 is provided in order to enable a tool, such as a screwdriver, to be inserted through kickface 57 in order to conveniently adjust the right side wheel assembly as needed. Also provided on the right side of kickface 57 is a plurality of laterally extending slots, one of which is indicated at 88. Slots 88 are adapted to receive a hinge bracket cover member (not shown) in a snap-fit manner. Slots 88 are utilized in accordance with the preferred invention to enable the hinge bracket cover member to shift laterally a limited degree. This degree of shifting generally corresponds to a permissible amount of shifting of lower hinge bracket 38 in the mounting thereof. In order to enable lower hinge bracket 38 to shift laterally for adjustment of fresh food door 34 relative to cabinet shell 5, fasteners 84 actually extend through laterally extending slots 89 formed in lower hinge bracket 38.

Arranged across a substantial portion of front face 67 of kickface 57 are multiple laterally spaced, elongated openings 90. Actually, the preferred embodiment illustrates eight sets of vertically spaced openings 90 but, of course, the number and arrangement of the openings could readily vary without departing from the spirit of the invention. Actually, the uppermost two rows of openings 90 shown in this embodiment are preferably fake and therefore do not actually constitute openings per se. On the other hand, lowermost two rows of openings 90 are provided to permit ventilation and air flow beneath cabinet shell 5. Again, the left end of kickface 57 incorporates features generally commensurate with those associated with the right end and therefore the description of this similar structure will not be reiterated here. However, the left end of kickface 57 is preferably provided with an additional enlarged hole 99. Hole 99 is actually provided to enable a water supply tube to emerge from behind kickface 57 and to extend upward through lower hinge unit 47 and into freezer door 43 within which a water dispenser is preferably provided. Hole 99 is enlarged since it preferably seats a connector that enables quick detachment of the water supply line in the event that freezer door 43 needs to be removed from cabinet shell 5.

Each end of kickface 57 is also preferably formed with a pair of upstanding pegs 104 and 105 which are used for interconnecting kickface 57 to cabinet shell 5 in the manner which will be described in detail below. In accordance with a first preferred embodiment of kickface 57 as shown in this figure, kickface 57 is also formed with an elongated recess 109 within which is adapted to be mounted, such as through an adhesive, a metal strip or plate 112. Recess 109 and metal strip 112 are adapted to be arranged such that, upon complete assembly of refrigerator cabinet 2, the lowermost portions of annular gaskets 53 and 54 overlie metal strip 112. This arrangement is provided since, in the preferred embodiment, each of annular gaskets 53 and 54 constitute magnetic sealing members and therefore include one or more magnetic elements therein which aid in properly seating gaskets 53 and 54 against cabinet shell 5. However, since gaskets 53 and 54 are adapted to overlie kickface 57 and kickface 57 is formed of plastic, metal strip 112 is provided to assure an effective seal along the bottom of doors 34 and 43.

Figure 2:
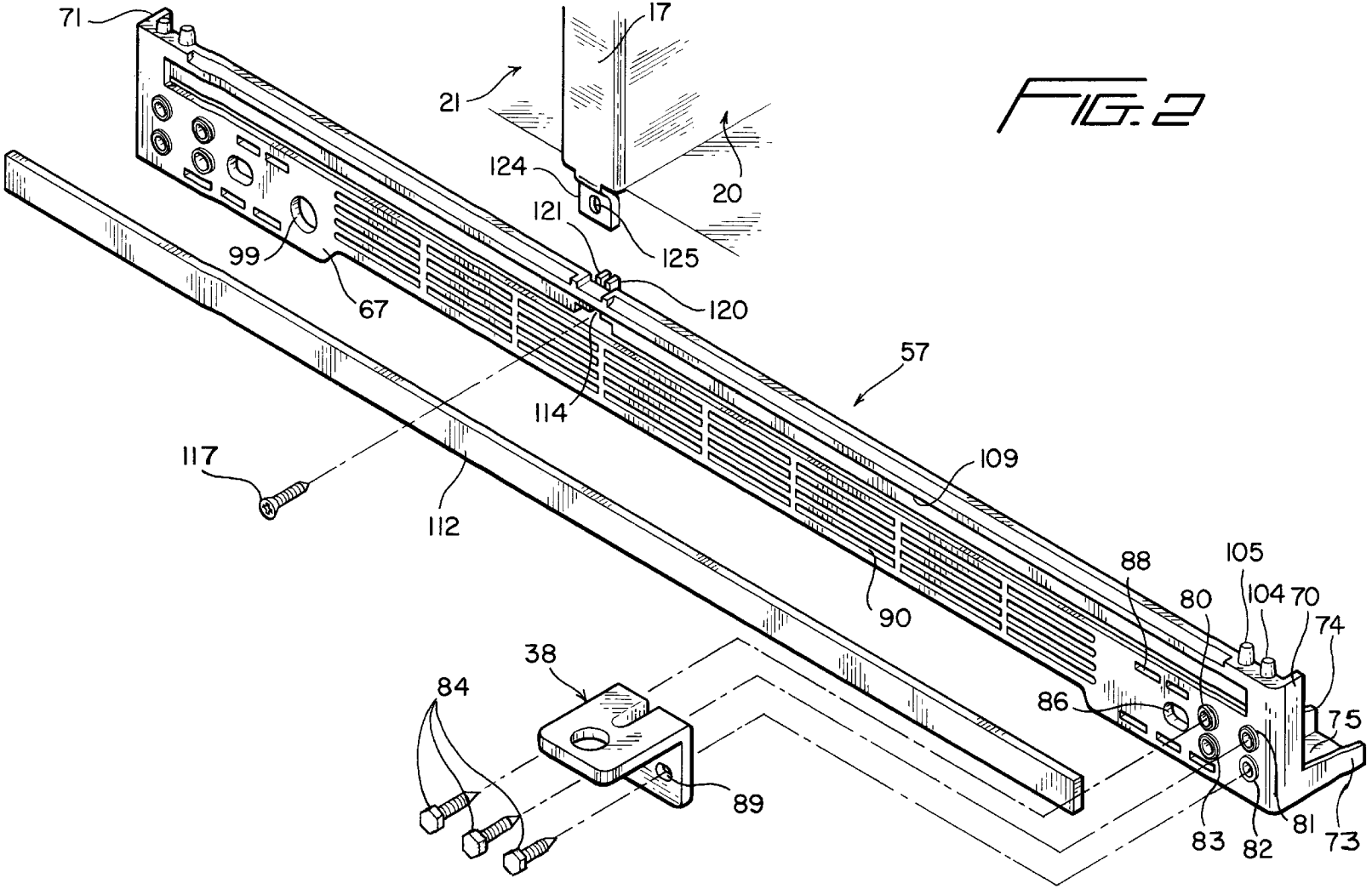
FIG. 2 is an exploded perspective view of a plastic kickface, as well as other components, incorporated in a first preferred embodiment of the refrigerator cabinet assembly of the invention.
Figures 3, 6:
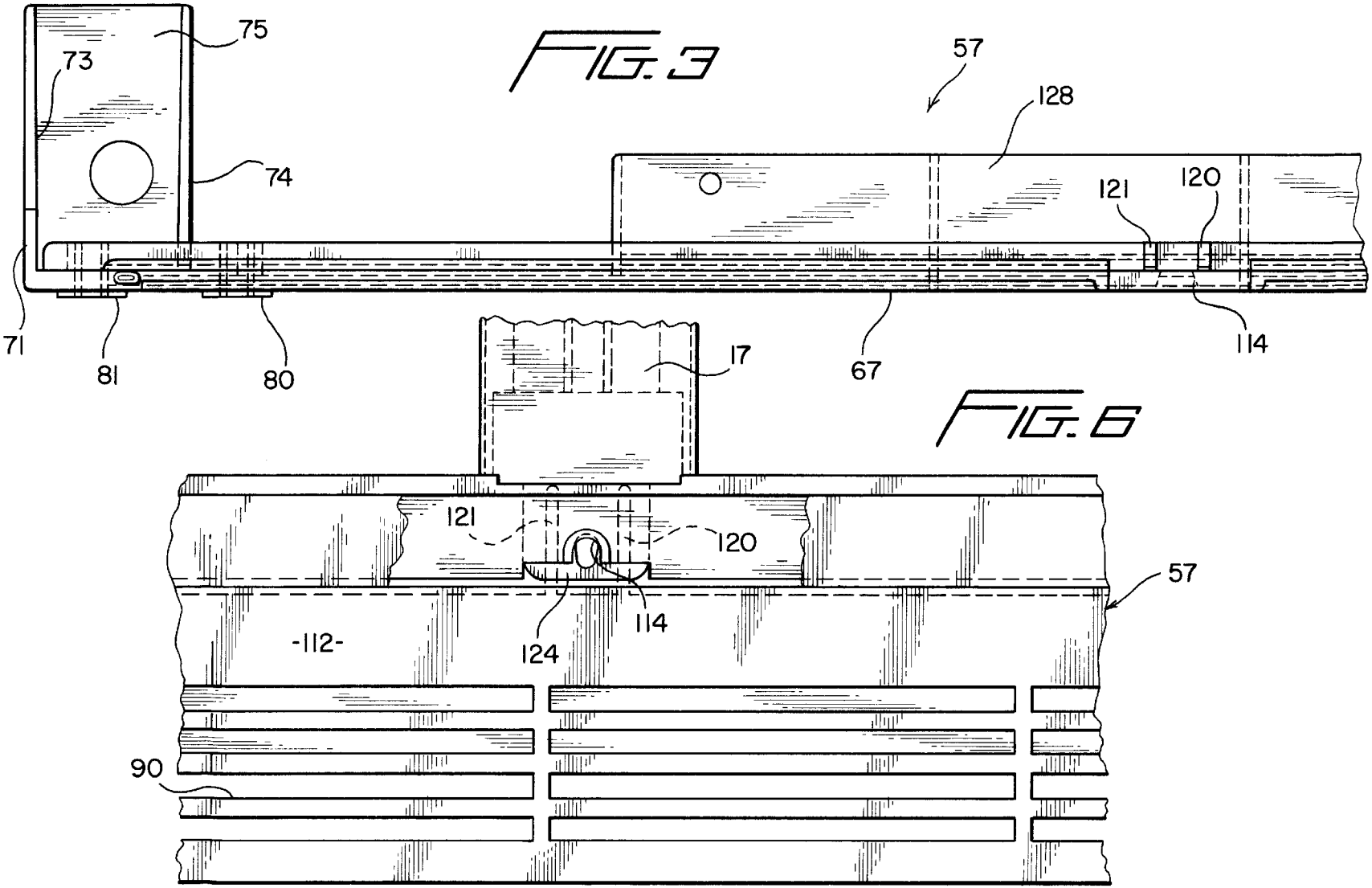
FIG. 3 is a partial top view of the kickface of FIG. 2.
FIG. 6 is a centered detailed view of a kickface to mullion bar attachment in accordance with the first preferred embodiment of the invention.
Figure 7:
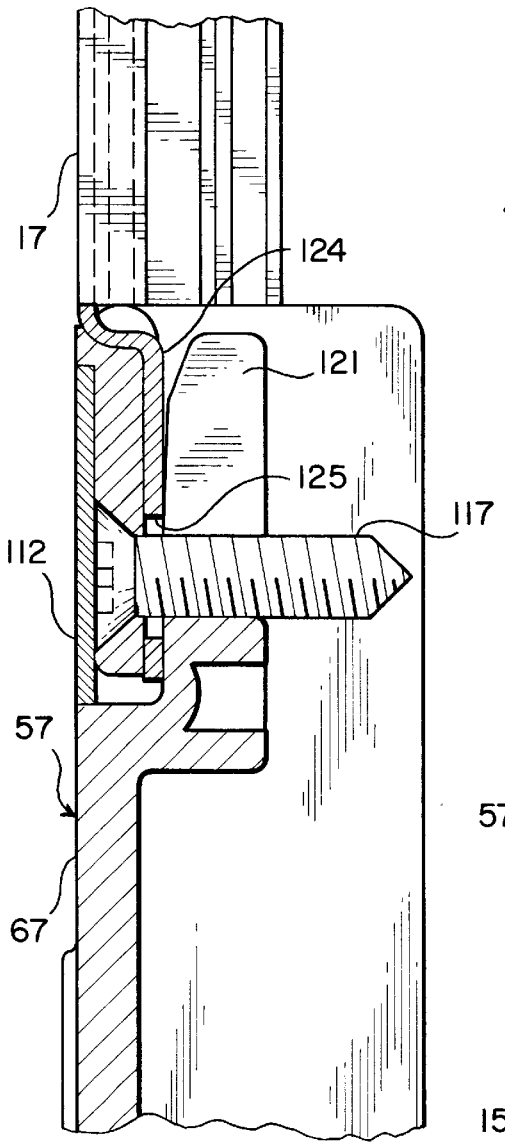
FIG. 7 is a cross-sectional view generally taken through the kickface to mullion bar attachment of FIG. 6.

An aperture 114 is also provided within kickface 57 at a central position defined within elongated recess 109 (also see FIGS. 3 and 6). Aperture 114 is adapted to receive a screw 117 upon assembling of kickface 57 to cabinet shell 5. More specifically, this portion of kickface 57 is provided with a pair of upstanding ribs 120 and 121 that are spaced rearwardly from front face 67 (also see FIGS. 2 and 7) such that a lower tab 124 of mullion bar 17 can be received between front face 67 and upstanding ribs 120 and 121. Tab 124 is provided with a through hole 125 through which screw 117 extends, after which, screw 117 is threaded into a laterally extending reinforcing member (not shown) of cabinet shell 5. Therefore, screw 117 represents one manner of attachment of kickface 57 to cabinet shell 5. As also shown in FIG. 3, kickface 57 is integrally formed with a rearwardly extending central plate portion 128 that is adapted to extend beneath mullion bar 17 and the liners for fresh food and freezer compartments 20 and 21 upon assembly of kickface 57 to the remainder of refrigerator cabinet 2.

Figure 4:
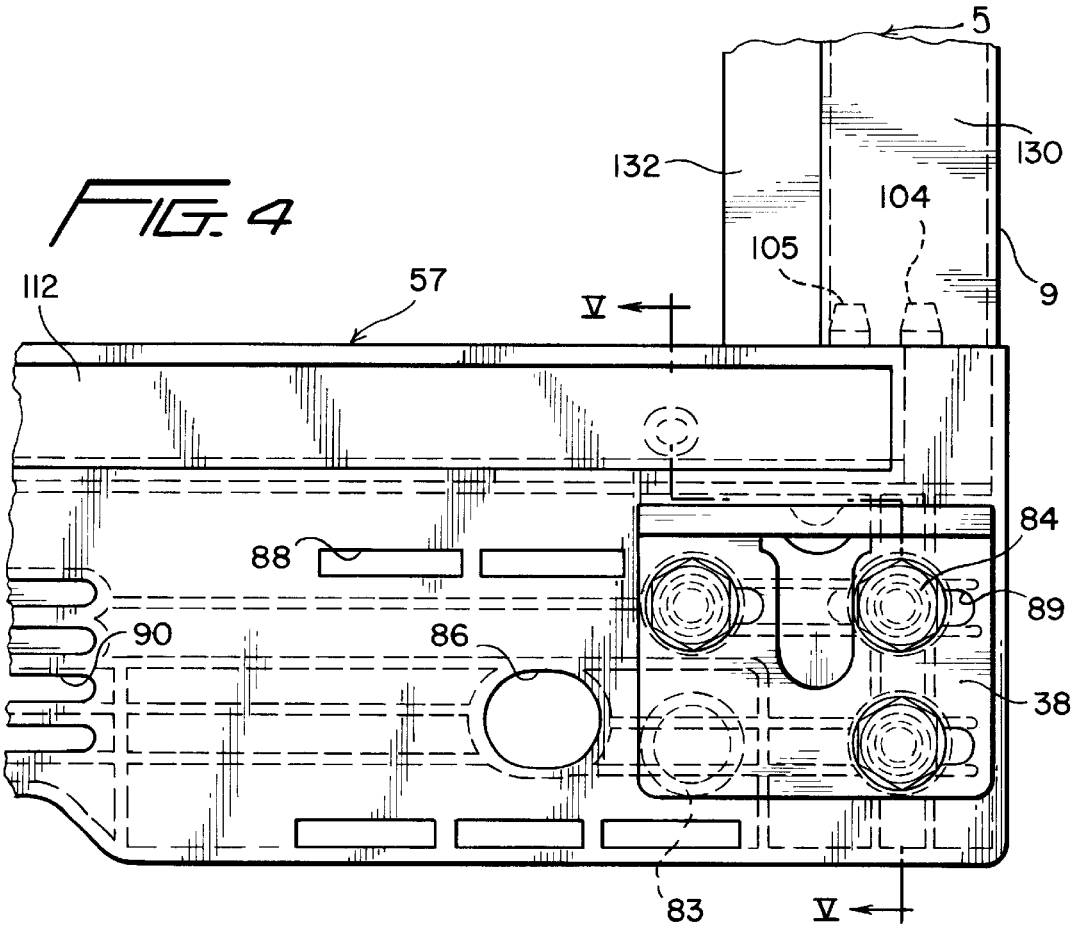
FIG. 4 is a right front end detailed view of the refrigerator cabinet assembly of the first embodiment in a partially assembled state.
Figure 5:
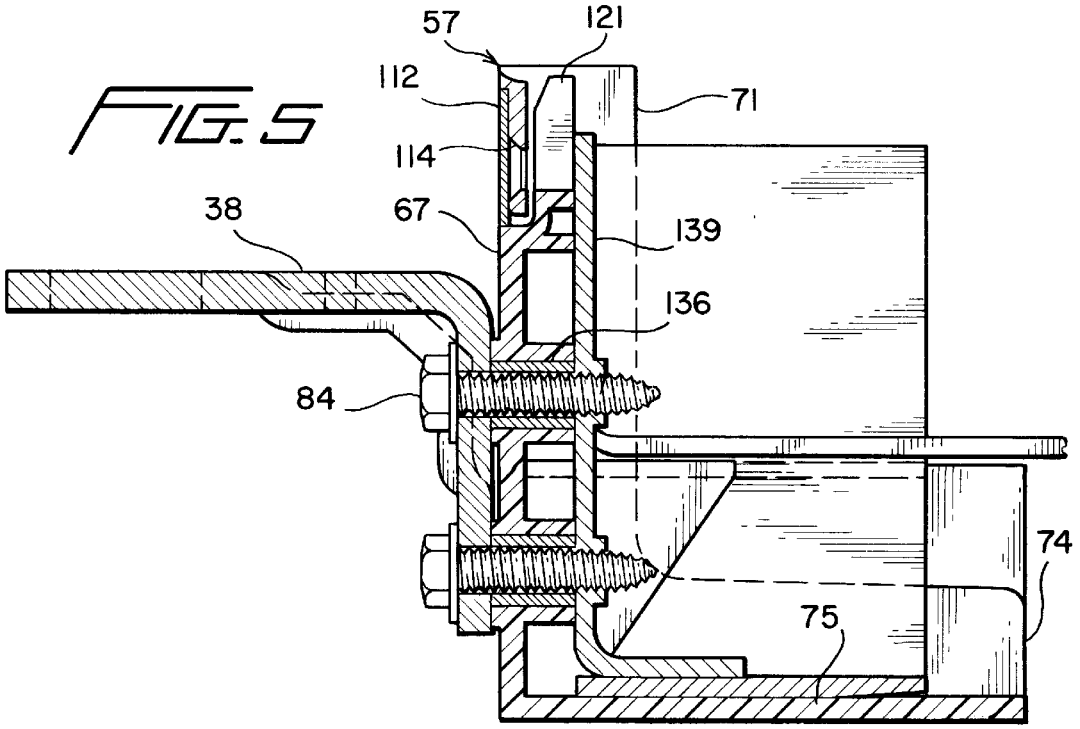
FIG. 5 is a cross-sectional view generally taken along line V—V of FIG. 4.

Reference will now be made to FIGS. 4–6 in describing the preferred manner in which kickface 57, constructed in accordance with the first embodiment of the invention, is interconnected to cabinet shell 5. Kickface 57 is initially attached to cabinet shell 5, prior to mounting of fresh food and freezer doors 34 and 43, by initially interengaging upstanding prongs 104 and 105 at each end of kickface 57 to the face portions of cabinet shell 5 adjacent side panels 8 and 9, while simultaneously positioning tab 124 against upstanding ribs 120 and 121. The arrangement of upstanding prongs 104 and 105 on the right end of kickface 57 is best shown in FIG. 4 wherein the metal sheet of side panel 9 is bent around the front of cabinet shell 5 to form a primary flange 130 of cabinet shell 5, is then bent back upon itself to form a secondary flange (not shown) and then is again bent back to form a return flange 132.

As indicated above and known in the art, the sheet metal of cabinet shell 5 is actually roll-formed to create primary and return flanges 130 and 132, which are spaced from each other to define a liner flange receiving cavity (not shown). In any event, upstanding prongs 104 and 105 are received between primary and return flange 130 and 132 in a tongue-in-groove manner to provide proper alignment of kickface 57 relative to cabinet shell 5. At the same time, side extension 70 extends about side panel 9 and a portion of cabinet shell 5 becomes seated against base 75 and between upstanding leg 73 and 74. At this point, screw 117 can be inserted within aperture 114, through hole 125 and then threaded into a rear reinforcing cross member of cabinet shell 5 in order to positively interconnect kickface 57 to cabinet shell 5.

As clearly shown in FIG. 5, lower hinge bracket 38 is generally L-shaped and is secured to cabinet shell 5 through kickface 57. In order to avoid any cold flow or other deformation of the plastic material which forms kickface 57 when torque is applied to each of the fasteners 84 in mounting both lower hinge brackets 38 and 47, tubular spacers 136, which are preferably formed of metal, are inserted to the hole provided in each of bosses 80–82. Each tubular spacer 136 has an associated length which is slightly greater than the thickness of kickface 57 at bosses 80–83 such that each lower hinge bracket 38 and 47 can be fixedly secured to a respective shell reinforcing member 139 of cabinet shell 5 through the use of fasteners 84 without deforming kickface 57. Of course, this interconnection between lower hinge brackets 38 and 47 of cabinet shell 5 also further locates and interconnects kickface 57 to cabinet shell 5.

In the preferred embodiment, tubular spacers 136 are actually pressed into the holes 86 of mounting bosses 80–82 immediately after the molding cycle for kickface 57 as completed. With this arrangement, the plastic forming kickface 57 is still warm which enables the tubular spacers 136 to be positively retained within the bosses 80–82 after the plastic cools. In order to enable some adjustability in the alignment of both fresh and refrigerator doors 34 and 43, each of the holes 89 formed in lower hinge brackets 38 and 47 actually, as previously mentioned, preferably constitute laterally extending slots as indicated in FIGS. 2 and 4. This enables some lateral shifting of each of the lower hinge brackets 38 and 47. In addition, as also indicated above, kickface 57 is provided with slots 88 to receive lower hinge bracket cover members (not shown). Again, the provision of slots 88 for the cover members (not shown) for lower hinge brackets 38 and 47 will enable the cover members to extend over the lower hinge brackets 38 and 47 and to shift commensurate therewith as needed.

Either before or after the mounting of lower hinge brackets 38 and 47, metal strip 112 is inserted into elongated recess 109. When mounted, metal strip 112 overlies screw 117 such that screw 117 is not visible from the front of refrigerator cabinet 2. In this preferred embodiment, metal strip 112 is adhesively secured within elongated recess 109, but it should be equally understood that various other securing arrangements, including the use of additional mechanical fasteners or molding kickface 57 with retention elements which enables a snap-fit for metal strip 112, could also be employed. In any event, when mounted, metal strip 112 is preferably, substantially flush with front face 67 of kickface 57 as clearly illustrated in FIGS. 5 and 7. Since kickface 57 takes the place of both a conventional metal face plate and a plastic kickplate, it is important in accordance with the present invention that the lowermost portions of annular gaskets 53 and 54 overlie metal strip 112 when fresh food and freezer doors 34 and 43 are closed. Strip 112 is made of metal since annular gaskets 53 and 54 preferably constitute magnetic door seals which are commonly used in the art. However, such types of seals are not absolutely necessary and, if solely rubber gaskets are utilized, a smooth surface finish at this portion of the front face 67 of kickface 57 could simply be provided for adequate sealing purposes. In any event, the lowermost portion of the gaskets 53 and 54 for fresh food and freezer doors 34 and 43 overlie a portion of kickface 57 when the doors 34 and 43 assume their closed positions.

Figure 8:
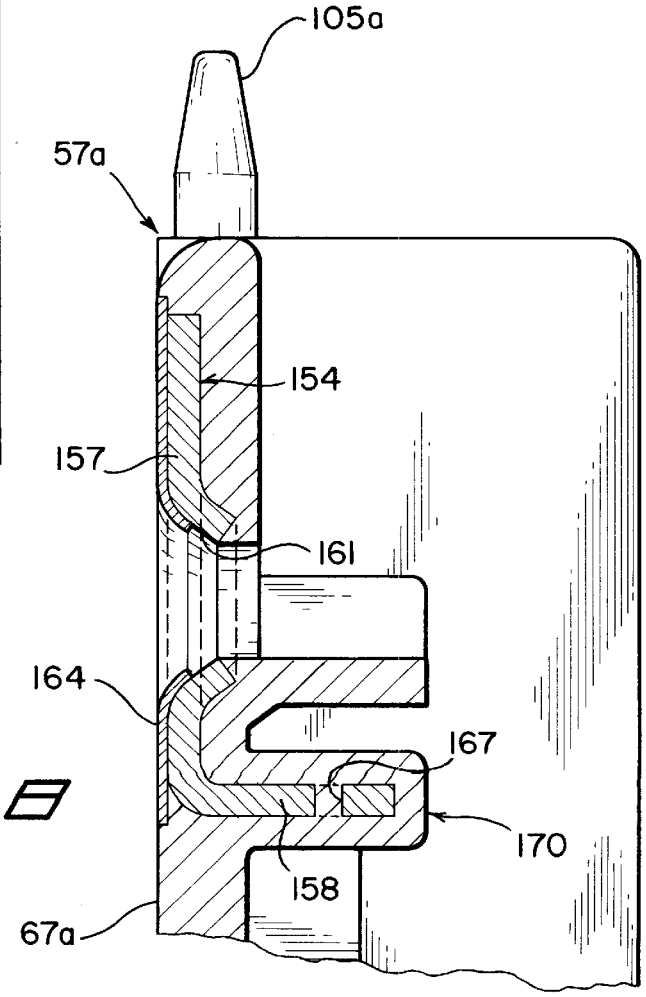
FIG. 8 is a partial cross-sectional side view of a kickface constructed in accordance with a second embodiment of the present invention.

FIG. 8 illustrates another preferred embodiment for kickface 57*a* which is substantially identical to the embodiment described above except with respect to the mounting and configuration of the metal strip which cooperates with annular gaskets 53 and 54 for sealing about fresh food and freezer doors 34 and 43. In accordance with this embodiment, a generally L-shaped, elongated metal strip 154 having a first, substantially vertical leg 157 and a second, substantially horizontal leg 158 is utilized in place of metal strip 112. In this embodiment, metal strip 154 is incorporated as an integral part of kickface 57*a* and is preferably provided with a series of laterally spaced apertures, one being indicated at 161, which are actually used to further mount kickface 57*a* to cabinet shell 5 in the final assembly of refrigerator cabinet 2. In any event, in accordance with this embodiment, a label insert 164 is also provided against leg 157 of metal strip 154 at the front face 67*a* of kickface 57*a*. In addition, second leg 158 is provided with a plurality of laterally spaced through holes, one of which is indicated at 167.

Apertures 161 provide a holding and locating arrangement for label insert 164 and metal strip 154 while loading of these elements during the injection molding process for kickface 57*a*. More specifically, label insert 164 and metal strip 154 are initially loaded into a mold with mold pins extending into apertures 161 before halves of the mold are closed in preparation for the plastic injection phase of the process. As the mold closes, a series of spring loaded pins (not shown) engage the rear surface of metal strip 154 to essentially clamp metal strip 154 and label insert 164 against one of the sections of the mold. This arrangement ensures intimate contact between label insert 164 and the mold, as well as between label insert 164 and metal strip 154. In addition, the use of such spring loaded pins assures the straightening of both parts prior to the plastic being injected into the mold.

When injected into the mold, the plastic will obviously form kickface 57*a* but, at the same time, will flow into through holes 167 in order to structurally lock the metal strip 154 permanently within the plastic kickface 57*a*. Actually, as clearly shown in this figure, second leg 158 of metal strip 154 basically becomes surrounded by an encapsulating portion, generally indicated at 170, of kickface 57*a*. Although label insert 164 is not considered a necessary component in accordance with the present invention, it has been found that the use of label insert 164 in combination with the injection of plastic material about portions of metal strip 154 enables metal strip 154 to be basically, hermetically sealed. In this manner, metal strip 154 does not become exposed to moisture and oxygen which would facilitate rusting thereof. Therefore, metal strip 154 need not be painted in accordance with the present invention. In the preferred embodiment, label insert 164 simply constitutes a thin plastic overlay and therefore can readily conform to the shape of first leg 157 of metal strip 154. An additional advantage of the second embodiment is that the metal strip 154, now being an integral part of plastic kickface 57*a*, will function to stiffen the upper area of kickface 57*a* to prevent any bowing which could compromise the seal for fresh food and freezer doors 34 and 43.

Figure 9:
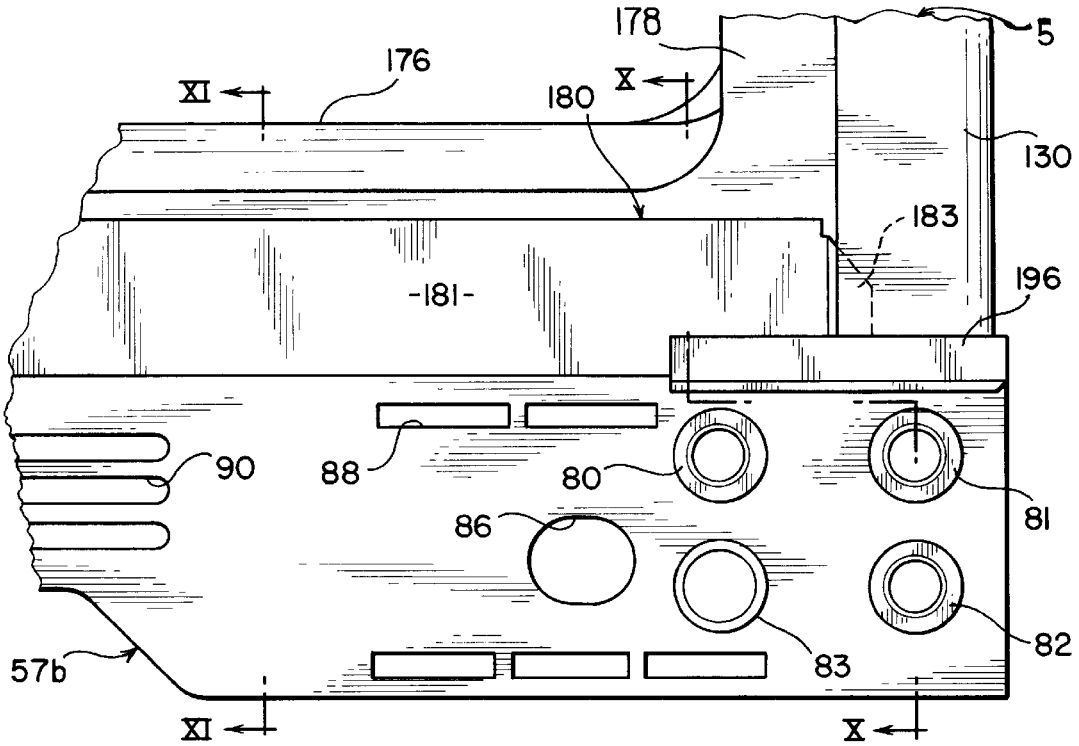
FIG. 9 is a right front end detailed view, similar to that of FIG. 4, of a third kickface embodiment constructed in accordance with the present invention.
Figure 10:
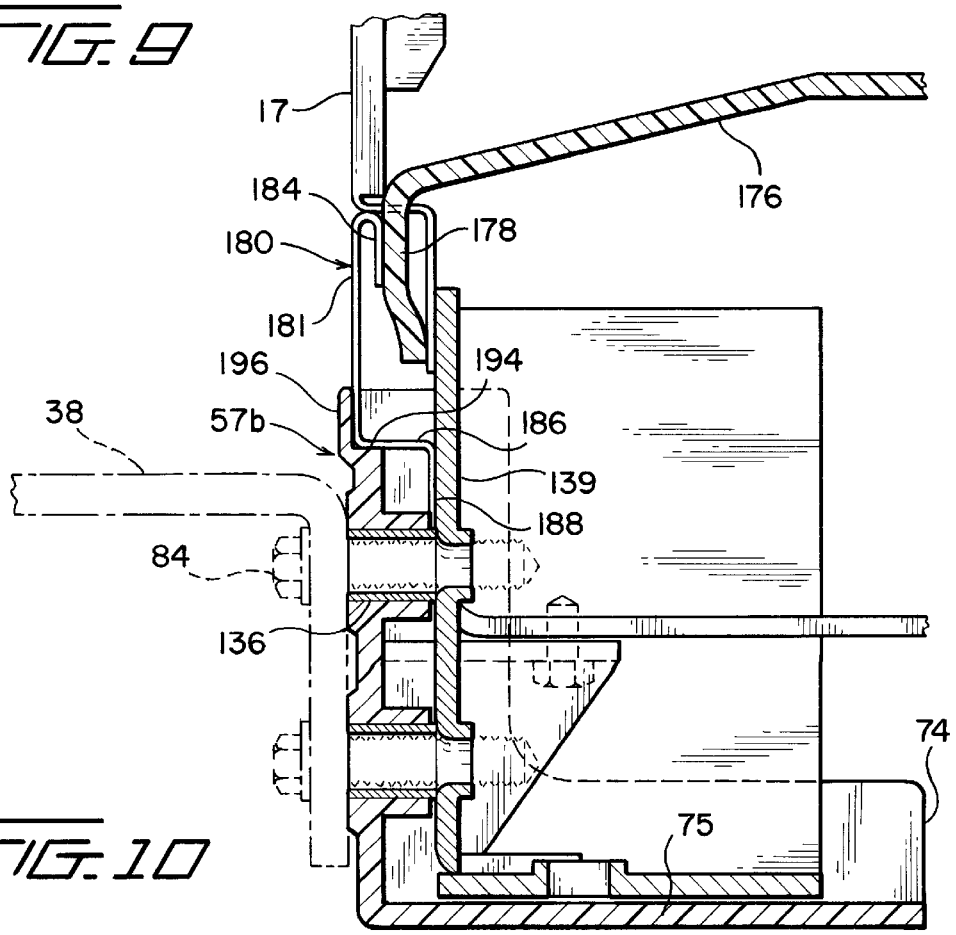
FIG. 10 is a cross-sectional view generally taken along line X—X of FIG. 9.
Figure 11:
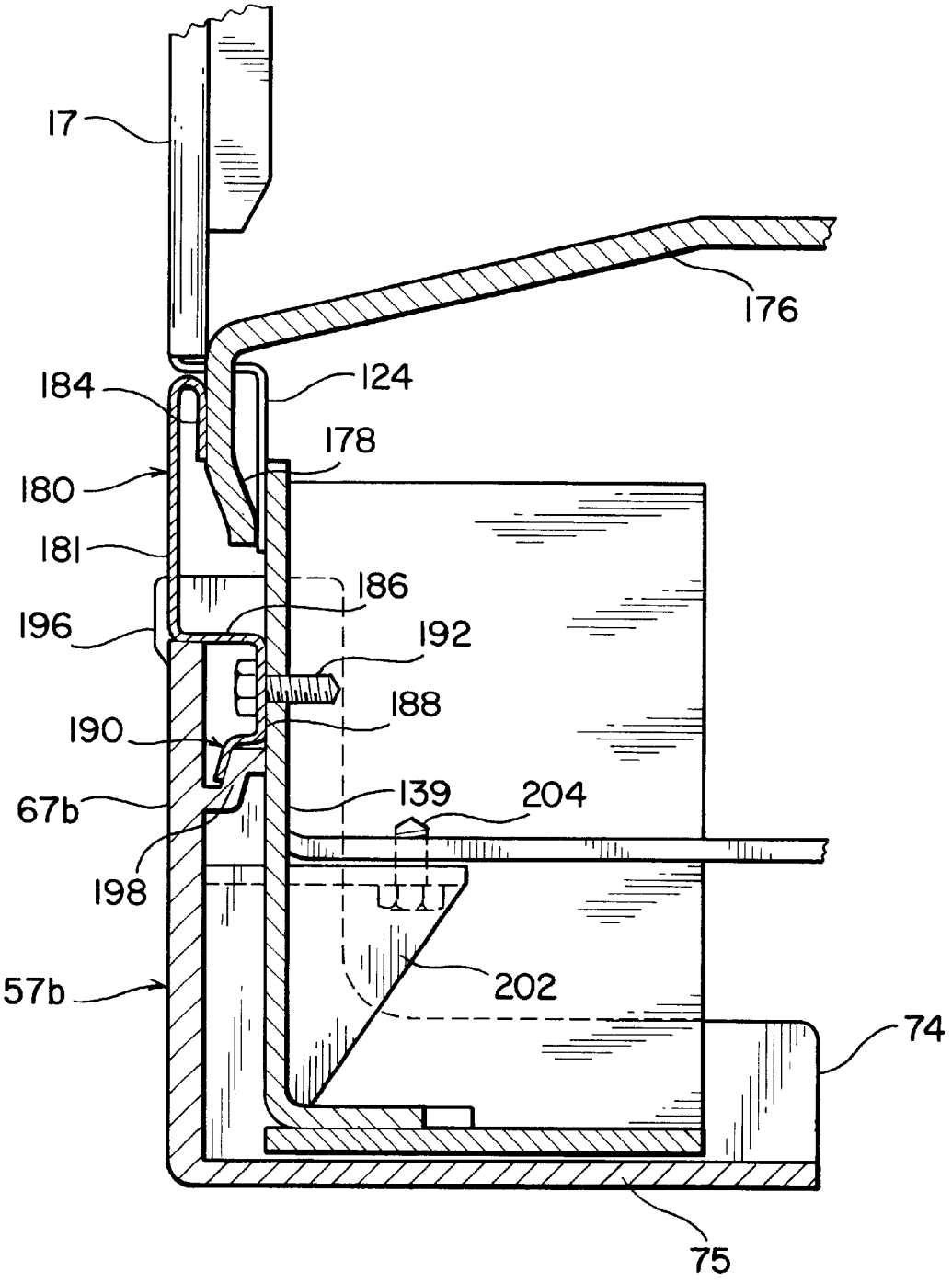
FIG. 11 is a cross-sectional view generally taken along line XI—XI of FIG. 9.

In each of the embodiments described above, metal strips 112 and 154 are placed at the front face of the respective kickface 57 and 57*a*. FIGS. 9–11 illustrate another embodiment of the invention that is configured slightly differently. More specifically, with reference to these figures, the liner 176 provided in refrigerator cabinet 5 is shown to include an out-turned flange 178. A metal strip 180 constructed in accordance with this embodiment of this invention includes an upper front leg 181 that defines an exposed outer surface, end tabs 183, an upper rear leg 184, an in-turned section 186, a lower vertical leg section 188 and a bottom lip 190. In accordance with this embodiment, metal strip 180 is affixed by initially positioning end tabs 183 between the out-turned flange 178 of liner 176 and primary flange 130 on each lateral side of cabinet shell 5 as best shown in FIG. 9. Then various laterally spaced screws 192 secure metal strip 180 to shell reinforcing member 139 as best illustrated in FIG. 11. At the same time, upper rear leg 184 abuts out-turned flange 178 of liner 176 laterally across refrigerator cabinet 2.

Once metal strip 180 is secured in this manner, a plastic kickface 57*b* is subsequently interconnected to both metal strip 180 and reinforcing structure of cabinet shell 5. More specifically, the upper lateral ends of kickface 57*b* is formed with a ledge 194 defined by a pair upper front extensions 196. Extensions 196 preferably extend over primary flange 130 and at least a portion of the interconnection between tabs 183 and primary flange 130 (see FIG. 9). With this arrangement, upper front extensions 196 provides a more aesthetically appealing arrangement, while also providing an assembly seating with metal strip 180 due to the presence of ledges 194.

Plastic kickface 57*b* is also formed with one or more laterally spaced and rearwardly extending extending retainer arms 198 (see FIG. 11) which project rearwardly from kickface 57*b*. In the preferred embodiment, each retainer arm 198 includes a portion which abuts shell reinforcing member 139 and another portion that engages bottom lip 190 of metal strip 180 as clearly shown in FIG. 11. With this arrangement, bottom lip 190, shell reinforcing member 139 and retainer arm 198 properly maintain kickface 57*b* in a desired fore-to-aft position with respect to cabinet shell 5. With this preferred construction, kickface 57*b* is initially attached by positioning retainer arm 198 under bottom lip 190 and then base 75 is slipped into position beneath cabinet shell 5. Preferably, kickface 57*b* also includes one or more laterally spaced gussets 202 that are subsequently secured by means of respective screws 204 (see FIG. 10) to lower frame member 206.

At this point, it should be realized that this embodiment differs from the embodiments of FIGS. 1–8 basically in the manner in which metal strip 180 and kickface 57*b* are mounted and interconnected. Therefore, it should be realized that kickface 57*b* includes structure directly corresponding to that described above with respect to kickfaces 57 and 57*a*, particularly regarding the manner in which lower hinge bracket 38 is secured to shell reinforcing member 139 through the use of screws 84 and tubular spacers 136. Therefore, this embodiment merely represents another manner in which a sealing strip can be provided in combination with a plastic kickface in accordance with the present invention.

By the above discussion, it should be readily apparent that the use of a plastic kickface constructed in accordance with the present invention reduces the manufacturing costs and simplifies assembly for refrigerator cabinet 2 over known prior art arrangements, while providing the structure necessary to assure proper sealing of one or more refrigerator doors. In addition, the kickface can be advantageously molded to directly conform to the shape of cabinet shell and will therefore reduce or eliminate leakage of subsequently injected insulating foam in various areas of fresh food and freezer liner flanges, particularly due to the end construction of the kickface and the presence of central plate portion 128. Furthermore, this kickface arrangement can be advantageously used to allow a yoder tube to be provided along the bottom edge of a freezer compartment to eliminate possible condensation in this area. In any event, although described with respect to the preferred embodiments of the invention, it should be readily understood that various changes and/or modifications can be made to the invention without departing from the spirit thereof. For instance, although the kickface of the invention has been disclosed for use in connection with a side-by-side refrigerator, it should be readily apparent that a similar arrangement can be utilized in connection with refrigerators having fresh food and refrigerator compartments that are vertically spaced within a cabinet shell. In these types of refrigerators, only the lowermost portion of the annular seal of one of the fresh food or freezer doors would overlie the kickface. In any event, in general, the invention is only intended to be limited by the scope of the following claims.

We claim:

1. A refrigerator cabinet assembly comprising:

a cabinet shell including a pair of laterally spaced side panels, each of which includes upper and lower end portions, a top panel interconnecting the upper end portions of the side panels, and an open frontal section permitting access to within the cabinet shell;

a plastic kickface extending across the frontal section of the cabinet shell at the lower end portions of the side panels, said kickface having a forwardly exposed face portion;

a door pivotally mounted to the cabinet shell about a substantially vertical axis, which extends adjacent one of the side panels, for movement between an open position, wherein access to within the cabinet shell is permitted, and a closed position, wherein the door extends across at least part of the open frontal section of the cabinet shell;

a seal extending about an interior peripheral portion of the door, said seal being positioned directly adjacent the face portion of the kickface when the door assumes the closed position; and a generally vertically extending mullion bar for use in dividing the cabinet shell into separate fresh food and freezer compartments such that the refrigerator cabinet assembly constitutes a side-by-side refrigerator, said mullion bar being interconnected to the kickface.

2. The refrigerator cabinet assembly according to claim 1, wherein the kickface incorporates means for assisting in sealing the seal thereagainst when the door assumes the closed position.

3. The refrigerator cabinet assembly according to claim 1, wherein the kickface is further formed, at opposing end sections thereof, with at least one upstanding prong adapted to be received within a cavity defined by the cabinet shell for interconnecting the kickface to the cabinet shell.

4. A refrigerator cabinet assembly comprising:

a cabinet shell including a pair of laterally spaced side panels, each of which includes upper and lower end portions, a top panel interconnecting the upper end portions of the side panels, and an open frontal section permitting access to within the cabinet shell;

a plastic kickface extending across the frontal section of the cabinet shell at the lower end portions of the side panels, said kickface having a forwardly exposed face portion;

a door pivotally mounted to the cabinet shell about a substantially vertical axis, which extends adjacent one of the side panels, for movement between an open position, wherein access to within the cabinet shell is permitted, and a closed position, wherein the door extends across at least part of the open frontal section of the cabinet shell; and a seal extending about an interior peripheral portion of the door, said seal being positioned adjacent the face portion of the kickface when the door assumes the closed position, wherein the kickface incorporates means for assisting in sealing the seal thereagainst when the door assumes a closed position, the seal assisting means including a strip of metal carried by one of the door and the kickface and at least one magnetic element carried by the other of the door and the kickface.

5. The refrigerator cabinet assembly according to claim 4, wherein the metal strip extends laterally across the face portion of the kickface.

6. The refrigerator cabinet assembly according to claim 5, wherein the face portion of the kickface is provided with an elongated recess within which the metal strip is mounted.

7. The refrigerator cabinet assembly according to claim 5, wherein the metal strip is molded into the kickface with at least a portion of the metal strip being encapsulated by the kickface.

8. The refrigerator cabinet assembly according to claim 7, wherein the metal strip includes first and second legs arranged in a generally L-shape in side-view, with the first leg extending along the face portion of the kickface and the second leg being encapsulated by the kickface.

9. The refrigerator cabinet assembly according to claim 8, wherein the second leg is provided with a plurality of holes into which plastic material of the kickface extends.

10. The refrigerator cabinet assembly according to claim 8, wherein the kickface is formed with a mullion bar receiving slot defined, at least in part, by an upstanding rib formed as part of the kickface and the kickface is further provided with a hole within the recess which is adapted to receive a threaded fastener that extends through a terminal end portion of the mullion bar.

11. The refrigerator cabinet assembly according to claim 5, further comprising a label insert overlying a part of the metal strip at the face portion of the kickface.

12. The refrigerator cabinet assembly according to claim 4, wherein the refrigerator cabinet assembly constitutes a side-by-side refrigerator that includes a generally vertically extending mullion bar for use in dividing the cabinet shell into separate fresh food and freezer compartments, with the mullion bar being interconnected to the kickface.

13. A refrigerator cabinet assembly comprising:

a cabinet shell including a pair of laterally spaced side panels, each of which includes upper and lower end portions, a top panel interconnecting the upper end portions of the side panels, and an open frontal section permitting access to within the cabinet shell;

at least one shell reinforcing frame member attached at the frontal section of the cabinet shell adjacent at least one of the lower end portions;

a plastic kickface formed separate from the cabinet shell and extending across the frontal section of the cabinet shell at the lower end portions of the side panels, said kickface having a forwardly exposed face portion;

a lower hinge bracket fixedly mounted, through a plurality of mechanical fasteners, to the at least one shell reinforcing frame member for use in pivotally mounting a door, with the mechanical fasteners extending through the kickface; and a door pivotally mounted to the cabinet shell about a substantially vertical axis, defined at least in part by said lower hinge bracket, for movement between an open position, wherein access to within the cabinet shell is permitted, and a closed position, wherein the door extends across at least part of the open frontal section of the cabinet shell.

14. The refrigerator cabinet assembly according to claim 13, wherein the kickface is provided with a plurality of holes through which the mechanical fasteners extend and the refrigerator cabinet assembly further comprises a plurality of tubular spacers that are positioned within the holes formed in the kickface.

15. The refrigerator cabinet assembly according to claim 14, further comprising a plurality of openings formed in the kickface for use in attaching a cover member for the lower hinge bracket.

16. The refrigerator cabinet assembly according to claim 13, further comprising:

a sealing strip extending across the side panels of the cabinet shell at the frontal section, said kickface being directly interconnected with said sealing strip; and a seal extending about an interior peripheral portion of the door, with said seal overlying the sealing strip when the door assumes the closed position.

17. The refrigerator cabinet assembly according to claim 16, further comprising:

a refrigerator liner positioned within the cabinet shell, said sealing strip including a portion abutting said liner.

18. The refrigerator cabinet assembly according to claim 16, wherein said sealing strip includes a lip portion and said kickface includes a retainer portion, said retainer portion being interengaged with said lip portion.

19. The refrigerator cabinet assembly according to claim 16, further comprising:

primary flanges formed as part of the cabinet shell at lateral spaced locations of the frontal section; and tabs provided at opposing lateral end portions of the sealing strip, each of said tabs being positioned behind a respective one of said primary flanges.

20. The refrigerator cabinet assembly according to claim 19, wherein said kickface includes at least one upper extension which extends over and across at least a section of each of the sealing strip and one of said primary flanges.

* * * * *